United States Patent [19]

Anton

[11] Patent Number: 5,076,956

[45] Date of Patent: Dec. 31, 1991

[54] COMPOSITIONS OF OCTAFLUOROTRIFLUOROMETHYLPENTANE AND NONAFLUOROTRIFLUOROMETHYLPENTANE AND USE THEREOF FOR CLEANING SOLID SURFACES

[75] Inventor: Douglas R. Anton, Claymont, Del.

[73] Assignee: E. I. Du Pont de Nemours and Company, Wilmington, Del.

[21] Appl. No.: 621,335

[22] Filed: Nov. 29, 1990

[51] Int. Cl.[5] ..... C11D 7/30; C11D 7/50; C23G 5/028; B08B 3/00

[52] U.S. Cl. ..... 252/162; 134/12; 134/31; 134/38; 134/39; 134/40; 252/153; 252/170; 252/171; 252/172; 252/364; 252/DIG. 9

[58] Field of Search ..... 252/153, 162, 170, 171, 252/172, 364, DIG. 9; 134/12, 31, 38, 39, 40; 203/67

[56] References Cited

U.S. PATENT DOCUMENTS

| | | | |
|---|---|---|---|
| 2,999,815 | 9/1961 | Eiseman | 252/171 |
| 2,999,817 | 9/1961 | Bower | 252/172 |
| 3,573,213 | 3/1971 | Burt | 252/172 |
| 3,728,268 | 4/1973 | Burt | 252/170 |
| 3,789,006 | 1/1974 | McMillan et al. | 252/171 |
| 3,881,949 | 5/1975 | Brock | 134/31 |
| 3,903,009 | 9/1975 | Bauer et al. | 252/171 |
| 4,324,930 | 4/1982 | von Halasz | 570/134 |
| 4,715,900 | 12/1987 | Connon et al. | 134/31 |
| 4,947,881 | 8/1990 | Magia et al. | 134/40 |

OTHER PUBLICATIONS

U. F. Snegirev et al., "Catalytic and Hydride Reduction of Hexafluoropropylene Dimers".

Li Jisen et al., Shanghai Inst. Org. Chem., Youji Huaxe, vol. 1, pp. 40–42, 24 (1984).

*Primary Examiner*—Paul Lieberman

*Assistant Examiner*—Linda D. Skaling

[57] ABSTRACT

Mixtures of the two fluorocarbon compounds 1,1,2,2,3,5,5,5-nonafluoro-4-trifluoromethylpentane and 1,1,1,2,2,5,5,5-octafluoro-4-trifluoromethylpentane with alcohols, ethers, esters, ketones, nitrogen-containing organic compounds, and halogenated hydrocarbons are disclosed; as is a process for cleaning a solid surface which comprises treating the surface with said mixtures. Ternary mixtures of about 88 to 96 weight percent total of said two fluorocarbon compounds with methanol (including at least about 11 weight percent 1,1,1,2,2,3,5,5,5-nonafluoro-4-trifluoromethylpentane and at least about 13 weight percent 1,1,1,2,2,5,5,5-octafluoro-4-trifluoromethylpentane) and with ethanol (including at least about 28 weight percent 1,1,1,2,2,3,5,5,5-nonafluoro-4-triluoformethylpentane and at least about 16 weight percent 1,1,1,2,2,5,5,5-octafluoro-4-trifluoromethyl-pentane) are disclosed as quasiazeotrope compositions that are useful where recovery and reuse of solvents is practiced.

17 Claims, No Drawings

COMPOSITIONS OF OCTAFLUOROTRIFLUOROMETHYLPENTANE AND NONAFLUOROTRIFLUOROMETHYLPENTANE AND USE THEREOF FOR CLEANING SOLID SURFACES

FIELD OF THE INVENTION

This invention relates to halogen substituted hydrocarbon compounds, their compositions and uses, and more particularly to fluorine-substituted hydrocarbons, their mixtures with solvents such as ethanol or methanol, and the use thereof for cleaning solid surfaces.

BACKGROUND OF THE INVENTION

Various organic solvents have been used as cleaning liquids for the removal of contaminants from contaminated articles and materials. Certain fluorine-containing organic compounds such as 1,1,2-trichloro-1,2,2-trifluoroethane have been reported as useful for this purpose, particularly with regard to cleaning organic polymers and plastics which may be sensitive to other more common and more powerful solvents such as trichloroethylene or perchloroethylene. Recently, however, there have been efforts to reduce the use of certain compounds such as trichlorotrifluoroethane which also contain chlorine because of a concern over their potential to deplete ozone, and to thereby affect the layer of ozone that is considered important in protecting the Earth's surface from ultraviolet radiation.

Boiling point, flammability and solvent power can often be adjusted by preparing mixtures of solvents. For example, certain mixtures of 1,1,2-trichloro-1,2,2-trifluoroethane with other solvents (e.g. isopropanol and nitromethane) have been reported as useful in removing contaminants which are not removed by 1,1,2-trichloro-1,2,2-trifluoroethane alone, and in cleaning articles such as electronic circuit boards where the requirements for a cleaning solvent are relatively stringent, (i.e., it is generally desirable in circuit board cleaning to use solvents which have low boiling points, are non-flammable, have low toxicity, and have high solvent power so that flux such as rosin and flux residues which result from soldering electronic components to the circuit board can be removed without damage to the circuit board substrate).

While boiling, flammability, and solvent power can often be adjusted by preparing mixtures of solvents, the utility of the resulting mixtures can be limited for certain applications because the mixtures fractionate to an undesirable degree during use. Mixtures can also fractionate during recovery, making it more difficult to recover a solvent mixture with the original composition. Azeotropic compositions, with their constant boiling and constant composition characteristics, are thus considered particularly useful.

Azeotropic compositions exhibit either a maximum or minimum boiling point and do not fractionate upon boiling. These characteristics are also important in the use of the solvent compositions in certain cleaning operations, such as removing solder fluxes and flux residues from printed circuit boards. Preferential evaporation of the more volatile components of the solvent mixtures, which would be the case if the mixtures were not azeotropes, or azeotrope-like, would result in mixtures with changed compositions which may have less desirable properties (e.g., lower solvency for contaminants such as rosin fluxes and/or less inertness toward the substrates such as electrical components).

Azeotropic characteristics are also desirable in vapor degreasing operations where redistilled material is usually used for final rinse-cleaning. Thus, the vapor defluxing or degreasing system acts as a still. Unless the solvent composition exhibits a constant boiling point, i.e., is an azeotrope or is azeotrope-like, fractionation will occur and undesirable solvent distribution may act to upset the safety and effectiveness of the cleaning operation.

A number of azeotropic compositions based upon halohydrocarbons containing fluorine have been discovered and in some cases used as solvents for the removal of solder fluxes and flux residues from printed circuit boards and for miscellaneous vapor degreasing applications. For example, U.S. Pat. No. 2,999,815 discloses the azeotrope of 1,1,2-trichloro-1,2,2-trifluoroethane with acetone; U.S. Pat. No. 3,903,009 discloses a ternary azeotrope of 1,1,2-trichloro-1,2,2-trifluoroethane with nitromethane and ethanol; U.S. Pat. No. 3,573,213 discloses an azeotrope of 1,1,2-trichloro-1,2,2-trifluoroethane with nitromethane; U.S. Pat. No. 3,789,006 discloses the ternary azeotrope of 1,1,2-trichloro-1,2,2-trifluoroethane with nitromethane and isopropanol; U.S. Pat. No. 3,728,268 discloses the ternary azeotrope of 1,1,2-trichloro-1,2,2-trifluoroethane with acetone and ethanol; U.S. Pat. No. 2,999,817 discloses the binary azeotrope of 1,1,2-trichloro-1,2,2-trifluoroethane and methylene chloride (i.e., dichloromethane); and U.S. Pat. No. 4,715,900 discloses ternary compositions of trichlorotrifluoroethane, dichlorodifluoroethane, and ethanol or methanol.

As noted above, many solvent compositions which have proven useful for cleaning contain at least one component which is a halogen-substituted hydrocarbon containing chlorine, and there have been concerns raised over the ozone depletion potential of halogen-substituted hydrocarbons which contain chlorine. Efforts are being made to develop compositions which may at least partially replace the chlorine containing components with other components having lower potential for ozone depletion. Azeotropic compositions of this type are of particular interest.

Unfortunately, as recognized in the art, it is not possible to predict the formation of azeotropes and this obviously complicates the search for new azeotropic systems which have application in this field. Nevertheless, there is a constant effort in the art to discover new azeotropes or azeotrope-like systems which have desirable solvent characteristics and particularly a greater range of solvent power.

SUMMARY OF THE INVENTION

This invention provides novel mixtures of the fluorohydrocarbon compounds, 1,1,1,2,2,3,5,5,5-nonafluoro-4-trifluoromethylpentane (HFC-53-12mmze) and 1,1,1,2,2,5,5,5-octafluoro-4-trifluoromethylpentane (HFC-54-11mmzf) with miscible solvents such as alcohols (e.g., methanol, ethanol, isopropanol, etc.), ethers (tetrahydrofuran, etc.), esters, ketones (e.g., acetone, methylethylketone, etc.), nitrogen-containing organic compounds (e.g., acetonitrile, nitromethane, etc.) and halogenated hydrocarbons (e.g., dichloromethane, 1,1,2-trichloro-1,2,2-trifluoroethane, dichlorodifluoroethane, trans-1,2-dichloroethene, trichloroethene, etc.). Mixtures with solvents which have azeotrope-like characteristics are preferred; and most preferred are mixtures which contain no chlorine.

There are provided in accordance with this invention novel quasiazeotrope compositions comprising an admixture of effective amounts of HFC-53-12mmze, HFC-54-11mmzf and an alcohol selected from the group consisting of methanol and ethanol, and, more specifically, an admixture of about 92 weight percent total of HFC-53-12mmze and HFC-54-11mmzf (including at least about 11 weight percent HFC-53-12mmze and at least about 13 weight percent HFC-54-11mmzf), and about 8 weight percent methanol, or about 92 weight percent total of HFC-53-12mmze and HFC-54-11mmzf (including at least about 28 weight percent HFC-53-12mmze and at least about 16 weight percent HFC-54-11mzf), and about 8 weight percent ethanol.

In use, the quasiazeotrope compositions of this invention are azeotrope-like in that during distillation the fluorohydrocarbon component (HFC-53-12mmze plus HFC-54-11mmzf) substantially behaves in total as a single component of an azeotrope (even though the weight ratio of the HFC-53-12mmze to the HFC-54-11mmzf can change) and thus minimizes the problem of fractionation and separate handling of the other components of the quasiazeotrope.

The mixtures of 1,1,1,2,2,3,5,5,5-nonafluoro-4-trifluoromethylpentane and 1,1,1,2,2,5,5,5-octafluoro-4-trifluoromethylpentane with miscible solvents, and particularly quasiazeotrope compositions of HFC-53-12mmze and HFC-54-11mmzf with solvents are well suited for solvent cleaning applications.

DETAILED DESCRIPTION OF THE INVENTION

The compound 1,1,1,2,2,3,5,5,5-nonafluoro-4-trifluoromethylpentane can be prepared by the reaction of iodine and hydrogen with perfluoro-2-methyl-2-pentene. The designation of this compound in conventional nomenclature for halogen substituted hydrocarbons containing fluorine is HFC-53-12mmze. Compositions containing HFC-53-12mmze may also be prepared in accordance with procedures described in V. F. Snegirev et al., Bull. Acad. Sci. USSR, Div. Chem. Sci. [Eng. Trans.], (12), 2489 (1984).

The compound 1,1,1,2,2,5,5,5-octafluoro-4-trifluoromethylpentane can be prepared by the reaction of hydrogen with perfluoro-2-methyl-2-pentene. The designation of this compound in conventional nomenclature for halogen substituted hydrocarbons containing fluorine is HFC-54-11mmzf. Compositions containing HFC-54-11mmzf may also be prepared in accordance with procedures described in V. F. Snegirev et al., Bull. Acad. Sci. USSR, Div. Chem. Sci. [Eng. Trans.], (12), 2489 (1984).

A mixture of HFC-53-12mmze and HFC-54-11mmzf can be obtained by the reaction of perfluoro-2-methyl-2-pentene and hydrogen over a rhodium catalyst (see Example 3 herein).

Mixtures of HFC-53-12mmze and HFC-54-11mmzf are miscible with various solvents conventionally used in cleaning operations. Compositions suitable for use in cleaning operations can be prepared which comprise a mixture of HFC-53-12mmze and HFC-54-11mmzf with one or more compounds selected from the group consisting of alcohols, ethers, esters, ketones, nitromethane, acetonitrile, and halogenated hydrocarbons. The preferred alcohols and halogenated hydrocarbons contain from 1 to 4 carbon atoms; the preferred ethers contain from 2 to 6 carbon atoms; and the preferred esters and ketones contain from 3 to 6 carbon atoms. Examples of suitable alcohols include methanol, ethanol and isopropanol. Examples of suitable ethers include tetrahydrofuran and diethyl ether. Examples of suitable ketones include acetone and methyl ethyl ketone. Examples of suitable halogenated hydrocarbons include methylene chloride (i.e., dichloromethane), 1,1,2-trichloro-1,2,2-trifluoroethane, dichlorodifluoroethane, trichloroethene, and trans-1,2-dichloroethylene. Preferably, such compositions contain at least about 5 percent by weight total of HFC-53-12mmze and HFC-54-11mmzf; and can contain a total of up to 99 percent by weight, or even more of HFC-53-12mmze and HFC-54-11mmzf. Preferably the weight ratio of HFC-53-12mmze to HFC-54-11mmzf in the compositions is between about 1:6 and 5:1. More preferably, the compositions of this invention contain from about 10 to about 90 percent by weight each of HFC-53-12mmze and HFC-54-11mmzf; and preferably the compositions of this invention contain from 1 to about 80 percent by weight other solvents. More preferably, the compositions contain no more than 60 percent by weight of said other solvent(s). Most preferred, with respect to ozone depletion potential are compositions in which all components contain no chlorine.

A composition which comprises an admixture of effective amounts of HFC-53-12mmze, HFC-54-11mmzf and one or more solvents selected from the group consisting of alcohols, ethers, esters, ketones, nitromethane, acetonitrile, and halogenated hydrocarbons to form a quasiazeotrope mixture, is considered especially useful. Compositions which are mixtures of HFC-53-12mmze and HFC-54-11mmzf with alcohol selected from the group consisting of methanol and ethanol are preferred.

By effective amounts is meant the amounts of each component of the admixture of the instant invention, which, when combined, results in the formation of the quasiazeotrope admixture of the instant invention.

By quasiazeotrope is meant liquid admixtures which are azeotrope-like in that during distillation the fluorocarbon component (HFC-53-12mmze plus HFC-54-11mmzf) behaves in total as one component of an azeotrope, with each other solvent of the quasiazeotrope behaving as other components of an azeotrope. Although quasiazeotropes of this invention include mixtures which are azeotrope or azeotrope-like; they can be nonazeotropic in that the weight ratio of the HFC-53-12mmze to the HFC-54-11mmzf in the mixture can change during distillation. Generally, the quasiazeotropes of this invention have a boiling point at 760 mm pressure which remains substantially unchanged during distillation of at least about 50 weight percent of the composition; and the weight ratio of the other component(s) to the total amount of HFC-53-12mmze and HFC-54-11mmzf varies over a small range during distillation of at least about 50% of the quasiazeotrope (e.g., the weight ratio for methanol or ethanol in a quasiazeotrope to the total fluoro-hydrocarbon content might vary from 0.042 to 0.14).

A quasiazeotrope composition may or may not be a true azeotrope. Thus, in such compositions, the composition of the vapor formed during boiling or evaporation has the same or substantially the same total weight percent of HFC-53-12mmze and HFC-54-11mmzf to the original liquid composition. Hence, during boiling or evaporation, the total weight percent of HFC-53-

12mmze plus HFC-54-11mmzf in the liquid composition, if it changes at all, changes only to a minimum extent; i.e, ±4%. This is to be contrasted to compositions which are not azeotrope-like in this manner in which during boiling or evaporation, the weight percent of a component in the liquid composition changes to a substantial degree with respect to other components of the compositions.

Thus, in order to determine whether a candidate mixture is a quasiazeotrope within the meaning of this invention, one only has to distill a sample thereof under conditions (i.e. resolution-number of plates) which would be expected to separate the mixture into its components. If the mixture is not a quasiazeotrope, the components of the mixture will fractionate, i.e., separate into its various components with the lowest boiling component distilling off first, and so on. If the mixture is a quasiazeotrope it will be azeotrope-like in that some finite amount of a first distillation cut will be obtained which contains all of the mixture components and which is constant boiling or (other than partially substituting one of the fluorohydrocarbons HFC-53-12mmze and HFC-54-mmfz for the other) behaves during distillation as a single substance.

It follows from the above that another characteristic of azeotrope-like compositions is that there is a range of compositions containing the same components in varying proportions which are azeotrope-like. All such compositions are intended to be covered by the term quasiazeotrope as used herein.

By "boiling point of the admixture at 760 mm pressure remains substantially unchanged during distillation of at least about 50 weight percent of the original admixture" is meant that the boiling point during about 50 weight percent distillation does not increase more than 4° C. from the boiling point of the starting admixture.

By azeotrope or azeotrope-like is meant constant boiling liquid admixtures of two or more substances which admixtures behave like a single substance in that the vapor produced by partial evaporation or distillation has the same composition as the liquid, i.e., the admixtures distill without a substantial change in composition. Constant boiling compositions characterized as azeotropes or azeotrope-like exhibit either a maximum or minimum boiling point as compared with that of nonazeotropic mixtures of the same substances.

It is possible to fingerprint, in effect, a constant boiling admixture, which may appear under varying guises depending on the conditions chosen, by any of several criteria.

The composition may be defined as an azeotrope of its components, say component A and component B, since the very term "azeotrope" is at once both definitive and limitative, requiring that effective amounts of A and B form this unique composition of matter which is a constant boiling admixture. It is well known by those who are skilled in the art that at differing pressures, the composition of a given azeotrope will vary, at least to some degree, and changes in distillation pressures also change, at least to some degree, the distillation temperatures. Thus, an azeotrope of A and B represents a unique type of relationship but with a variable composition depending on temperature and/or pressure. Therefore, compositional ranges, rather than fixed compositions, are often used to define azeotropes.

Or, the composition can be defined as a particular weight relationship or mole percent relationship of A and B, while recognizing that such specific values point out only one particular such relationship and that in actuality a series of such relationships represented by A and B actually exist for a given azeotrope, varied by influence of distillative conditions of temperature and pressure.

Or, recognizing that the azeotrope A and B does represent just such a series of relationships, the azeotropic series represented by A and B can be characterized by defining the composition as an azeotrope characterized by a boiling point at a given pressure, thus giving identifying characteristics without unduly limiting the scope of the invention by a specific numerical composition, which is limited by and is only as accurate as the analytical equipment available.

Quasiazeotrope compositions are provided in accordance with this invention which comprise admixtures of effective amounts of HFC-53-12mmze and HFC-54-11mmzf with an alcohol selected from the group consisting of methanol and ethanol to form a quasiazeotrope mixture. Quasiazeotropes include azeotrope and azeotrope-like compositions wherein during distillation the weight percents of HFC-53-12mmze and HFC-54-mmzf in the vapor are each the same or substantially the same as their weight percents in the liquid.

In accordance with this invention, compositions which are ternary mixtures of from about 11 to 78 weight percent HFC-53-12mmze and from about 13 to 80 weight percent HFC-54-11mmzf, provided that the weight percent of the HFC-53-12mmze/HFC-54-11mmzf mixture is from about 88 to 96, and from about 4 to 12 weight percent methanol, are characterized as quasiazeotropes in that mixtures within this range exhibit a substantially constant boiling point. Being substantially constant boiling, the fluorohydrocarbon component (i.e. HFC-54-12mmze plus HFC-54-mmzf) of the mixtures does not tend to fractionate from the other component(s) of the mixtures to any great extent upon evaporation. After evaporation, only a small difference exists between the percentage of said other component in the vapor and the percentage of said other compounds in the initial liquid phase. This difference is so small that, except for a possible change in ratio of HFC-53-12mmze to HFC-54-11mmzf in the fluorohydrocarbon component, the compositions of the vapor and liquid phases vary only over a small range of compositions, as defined above. Accordingly, any mixture within this range exhibits properties which are characteristic of quasiazeotropes. The ternary composition consisting essentially of about 92 weight percent of a HFC-53-12mmze/HFC-54-11mmzf mixture and about 8 weight percent methanol has been established, within the accuracy of the fractional distillation method, as a quasiazeotrope composition, boiling at about 46° C. at substantially atmospheric pressure and is a preferred quasiazeotrope composition of this invention.

Also, in accordance with this invention, compositions which are ternary mixtures of from about 28 to 77 weight percent HFC-53-12mmze and from about 16 to 65 weight percent HFC-54-11mmzf, provided that the weight percent of the HFC-53-12mmze/HFC-54-11mmzf mixture is from about 88 to 96, and from about 4 to 12 weight percent ethanol, are characterized as quasiazeotropes in that mixtures within this range exhibit a substantially constant boiling point. Being substantially constant boiling, the fluorohydrocarbon component (i.e. HFC-53-12mmze plus HFC-54-12mmzf) of the mixtures do not tend to fractionate from the other component(s) of the mixtures to any great extent upon evaporation. After evaporation, only a small difference exists between the percentage of said other components in the vapor and the percentage of said other components in the initial liquid phase. This difference is so small that, except for a possible change in ratio of HFC-53-12mmze to HFC-54-11mmzf in the fluorohydrocarbon component, the compositions of the vapor and liquid phases vary only over a small range of compositions, as defined above. Accordingly, any mixture within this range exhibits properties which are characteristic of azeotropes or azeotrope-like mixtures. The ternary composition consisting essentially of about 92 weight percent of a HFC-53-12mmze/HFC-54-11mmzf mixture and about 8 weight percent ethanol has been established, within the accuracy of the fractional distillation method, as a quasiazeotrope composition, boiling at about 52° C. at substantially atmospheric pressure and is a preferred quasiazeotrope composition of this invention.

Mixtures of HFC-53-12mmze and HFC-54-11mmzf, their quasiazeotrope compositions with methanol and ethanol, and other mixtures of this invention are useful in a wide variety of processes for cleaning solid surfaces which comprise treating said surface therewith. Applications include removal of flux and flux residues from printed circuit boards contaminated therewith.

The compositions of the invention may be used in conventional apparatus, employing conventional operating techniques. The solvent(s) may be used without heat if desired, but the cleaning action of the solvent may be assisted by conventional means (e.g. heating, agitation, etc.). In some applications (e.g. removing certain tenacious fluxes from soldered components) it may be advantageous to use ultrasonic irradiation in combination with the solvent(s).

The quasiazeotrope compositions of the present invention permit easy recovery and reuse of the solvent from vapor defluxing and degreasing operations because of their azeotropic nature. As an example, compositions provided in accordance with this invention can be used in cleaning processes such as is described in U.S. Pat. Nos. 3,881,949 and 4,715,900, both of which are incorporated herein by reference.

The quasiazeotrope compositions and other mixtures of the instant invention can be prepared by any convenient method including mixing or combining the desired amounts of the components. A preferred method is to weigh the desired amounts of each component and thereafter combine them in an appropriate container.

Practice of the invention will become further apparent from the following non-limiting examples.

EXAMPLES

Example 1

Preparation of
1,1,1,2,2,3,5,5,5-Nonafluoro-4-trifluoromethylpentane
(HFC-53-12mmze)

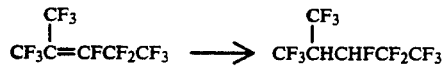

Perfluoro-2-methylpent-2-ene (3 g) and iodine (1.25 g) were sealed in a 10 mL pressure tube. The tube was cooled to −78° C., evacuated, and charged with 1500 psi of hydrogen at room temperature. The tube was then heated at 240° C. for 1 h, and 260° C. for 15 h. The tube was cooled, vented, and opened The liquid was washed with water, giving 1,1,1,2,2,3,5,5,5-nonafluoro-4-trifluoromethylpentane (1.38 g) which was 99.5% pure by GC analysis GC/IR 3000 $cm^{-1}$, w (C-H); 1288 $cm^{-1}$, vs (C-F); 1228 $cm^{-1}$, vs (C-F); 691 $cm^{-1}$, m. $^{19}$FNMR ($CCl_3F$ as internal standard): −62 ppm, c, 3F; −67 5 ppm, c, 3F; −83.9 ppm, t, 3F; −122–133 ppm, AB, 2F; −212.2 ppm, c, 1F. $^1$HNMR ($CHCl_3$ as internal standard): 5.27 ppm, dd, 1H; 3.55 ppm, c, 1H. The boiling point of this product was 67° C.

Example 2

Preparation of
1,1,1,2,2,5,5,5-Octafluoro-4-trifluoromethylpentane
(HFC-5-4-11mmzf)

The catalyst, a mixture of 50 g 0.5% Pd/C and 100 g $Al_2O_3$, was dried with nitrogen at 300° C. The temperature was lowered to 200° C. Hydrogen (100 mL/min) and perfluoro-2-methylpent-2-ene (10 mL/hr) were fed to the catalyst and the effluent collected at −78° C. The crude product was 0.5% starting material, 98% HFC-54-11mmzf) and 1.5% 1,1,1,2,2,3,5,5,5-nonafluoro-4-trifluoromethylpentane. Distillation gave cuts at 60°–61° C. (1 atm) which were >99% HFC-54-11mmzf.

Example 3

Preparation of HFC-53-12mmze (46%) and
HFC-54-11mmzf (54%)

Perfluoro-2-methylpent-2-ene (1.5 Kg) and water (700 g) were added to a 1 gal stirred autoclave along with 5% rhodium on carbon (10 g). The autoclave was sealed and evacuated. It was then heated to 50° C. and hydrogen was added to a pressure of 200 psi. The pressure and temperature were held until the uptake of hydrogen stopped (approx 1.5 hrs). The pressure of hydrogen was then increased to 500 psi and this pressure was held for an additional four hours. The clave was then cooled, bled and opened. The liquid was filtered through Celite® filter aid and the organic layer was separated giving 1.3 kg of clear liquid. This liquid was then distilled through a 15 plate Oldershaw column giving 950 g of a mixture of HFC-53-12mmze (46%) and HFC-54-11mmzf (54%).

Example 4

HFC-53-12mmzr/HFC-54-11mmzf/Methanol

A solution which contained 42.4 weight percent HCFC-53-12mmze, 49.4 weight percent HCFC-54-11mmzf and 8.2 weight percent methanol was prepared in a suitable container and mixed thoroughly.

The solution was distilled in a Perkin-Elmer Mode 251 Autoannular Spinning Band Still (200 plate fractionating capability), using a 30:1 reflux to take-off ratio. Head and pot temperatures were read directly to 0.1° C. All temperatures were adjusted to 760 mm pressure. Distillate compositions were determined by gas chromatography. Results obtained are summarized in Table 1.

TABLE 1

| DISTILLATION OF: HCFC-53-12mmze + HCFC-54-11mmzf + Methanol (42.4% + 49.4% + 8.2%) | | | | | | | |
|---|---|---|---|---|---|---|---|
| | TEMP. °C. | | WT. % DISTILLED OR RE- | | | | |
| CUTS | POT | HEAD | COVERED | 53-12 | 54-11 | MIX | MeOH |
| Fore | 47.8 | 45.3 | 9.31 | 89.87 | 0.89 | 90.76 | 9.24 |

TABLE 1-continued

| DISTILLATION OF: HCFC-53-12mmze + HCFC-54-11mmzf + Methanol (42.4% + 49.4% + 8.2%) | | | | | | | |
|---|---|---|---|---|---|---|---|
| | TEMP. °C. | | WT. % DISTILLED OR RE- | | | | |
| CUTS | POT | HEAD | COVERED | 53-12 | 54-11 | MIX | MeOH |
| 1 | 47.9 | 45.5 | 17.19 | 74.29 | 17.36 | 91.65 | 8.35 |
| 2 | 48.2 | 45.8 | 24.89 | 71.76 | 19.88 | 91.64 | 8.36 |
| 3 | 48.3 | 45.8 | 32.19 | 72.33 | 19.22 | 91.55 | 8.45 |
| 4 | 48.5 | 46.0 | 41.94 | 69.97 | 21.37 | 91.34 | 8.66 |
| 5 | 48.7 | 46.5 | 47.11 | 55.46 | 36.51 | 91.97 | 8.03 |
| 6 | 49.0 | 46.9 | 57.42 | 47.25 | 44.06 | 91.31 | 8.69 |
| 7 | 49.7 | 47.3 | 72.86 | 28.66 | 62.27 | 90.93 | 9.07 |
| 8 | 50.5 | 48.0 | 80.34 | 14.81 | 76.25 | 91.06 | 8.94 |
| Heel | | | 93.28 | 4.45 | 89.57 | 94.02 | 5.98 |

Analysis of the above data indicates very small differences between head temperatures and distillate compositions, as the distillation progressed. A statistical analysis of the data indicates that the azeotrope-like mixture of 53-12 mmze, 54-11mmzf and methanol has the following characteristics at atmospheric pressure (99 percent confidence limits):

53-12/54-11 MIX=91.6+/−0.9 wt. %
methanol=8.4+/−0.89 wt. %
Boiling point, °C.=46.1+/−1.9° C.

Example 5

HFC-53-12mmze/HFC-54-11mmzf/Ethanol

A solution which contained 42.4 weight percent HCFC-53-12mmze, 49.4 weight percent HCFC-54-11mmzf and 8.2 weight percent ethanol was prepared in a suitable container and mixed thoroughly.

The solution was distilled in a Perkin-Elmer Mode 251 AutoAnnular Spinning Band Still (200 plate fractionating capability), using a 30:1 reflux to take-off ratio. Head and pot temperatures were read directly 1° C. All temperatures were adjusted to 760 mm pressure. Distillate compositions were determined by gas chromatography. Results obtained are summarized in Table 2.

TABLE 2

| DISTILLATION OF: HCFC-53-12mmze + HCFC-54-11mmzf + Ethanol (42.4% + 49.4% + 8.2%) | | | | | | | |
|---|---|---|---|---|---|---|---|
| | TEMP. °C. | | WT. % DISTILLED OR RE- | | | | |
| CUTS | POT | HEAD | COVERED | 53-12 | 54-11 | MIX | MeOH |
| Fore | 53.1 | 50.2 | 10.01 | 82.28 | 10.12 | 92.40 | 7.60 |
| 1 | 53.1 | 50.4 | 16.38 | 72.77 | 20.02 | 92.79 | 7.21 |
| 2 | 53.3 | 50.4 | 24.55 | 63.22 | 29.24 | 92.46 | 7.54 |
| 3 | 50.7 | 50.7 | 35.10 | 65.95 | 26.51 | 92.46 | 7.54 |
| 4 | 53.8 | 51.0 | 44.55 | 66.13 | 26.38 | 92.51 | 7.49 |
| 5 | 54.3 | 51.8 | 51.10 | 49.41 | 43.01 | 92.42 | 7.58 |
| 6 | 54.7 | 51.8 | 59.64 | 32.46 | 59.93 | 92.39 | 7.61 |
| 7 | 55.2 | 52.6 | 66.28 | 36.89 | 55.62 | 92.51 | 7.49 |
| Heel | | | 86.15 | 3.17 | 85.49 | 88.66 | 11.34 |

Analysis of the above data indicates very small differences between head temperatures and distillate compositions, as the distillation progressed. A statistical analysis of the data indicates that the azeotrope-like mixture of 53-12mmze, 54-11mmzf and ethanol has the following characteristics at atmospheric pressure (99 percent confidence limits):

53-12/54-11 MIX=92.46+/−0.2 wt. %
ethanol=7.54+/−0.2 wt .%
Boiling point, °C.=51.6+/−3.0° C.

Example 6

Surface Cleaning with HFC-53-12mmze/HFC-54-11mmzf/ Methanol Azeotrope-Like Mixture A single-sided circuit board is coated with activated rosin flux, and soldered by passing the board over a preheater to obtain a top side board temperature of approximately 200° F. and then through 500° F. molten solder. The soldered board is defluxed in an azeotrope-like mixture of about 91.5 weight percent HFC-53-12mmze/HFC-54-11mmzf (in weight ratio of about 1:1) and about 8.5 weight percent methanol by suspending it, first for three minutes in the boiling sump, then one minute in the rinse sump and, thereafter, for one minute in the solvent vapor above the boiling sump. The board thus cleaned has no visible residue remaining on it.

Example 7

Surface Cleaning with HFC-53-12mmze/HFC-54-11mmzf/Ethanol Azeotrope-Like Mixture The circuit board cleaning process of Example 6 is repeated using an azeotrope-like mixture of about 92.5 weight percent HFC-53-12mmze/HFC-54-11mmzf (in weight ratio of about 1:1) and about 7.5 weight percent ethanol. The board thus cleaned has no visible residue remaining on it.

Particular embodiments of the invention are included in the Examples. Other embodiments will become apparent to those skilled in the art from a consideration of the specification or practice of the invention disclosed herein. It is understood that modifications and variations may be practiced without departing from the spirit and scope of the novel concepts of this invention. It is further understood that the invention is not confined to the particular formulations and examples herein illustrated, but it embraces such modified forms thereof as come within the scope of the following claims.

What is claimed is:

1. A composition comprising (i) between about 5 and 99 weight percent total of a mixture of 1,1,1,2,2,3,5,5,5-nonafluoro-4-trifluoromethylpentane and 1,1,1,2,2,5,5,5-octafluoro-4-trifluoromethyl-pentane and (ii) between about 1 and 80 percent by weight of at least one solvent selected from the group consisting of alcohols containing from 1 to 4 carbon atoms, esters containing from 3 to 6 carbon atoms, ethers containing form 2 to 6 carbon atoms, ketones containing from 3 to 6 carbon atoms, halogenated hydrocarbons containing from 1 to 4 carbon atoms, acetonitrile, and nitromethane.

2. A composition according to claim 1 which is a mixture of 1,1,1,2,2,3,5,5,5-nonafluoro-4-trifluoromethylpentane and 1,1,1,2,2,5,5,5-octafluoro-4-trifluoromethylpentane and at least one solvent selected from the group consisting of methanol, ethanol, isopropanol, tetrahydrofuran, acetone, methylene chloride, 1,1,2-trichloro-1,2,2-trifluoroethane, dichlorodifluoroethane, trichloroethene, trans-1,2-dichloroethylene, acetonitrile, and nitromethane.

3. The composition of claim 1 in which no component contains chlorine.

4. The composition of claim 1 which is a mixture of 1,1,1,2,2,3,5,5,5-nonafluoro-4-trifluoromethylpentane, 1,1,1,2,2,5,5,5-octafluoro-4-trifluoromethylpentane and solvent selected from the group consisting of methanol and ethanol.

5. The composition of claim 1 containing between about 5 and 99 weight percent total of 1,1,1,2,2,3,5,5,5-nonafluoro-4-trifluoromethylpentane and 1,1,1,2,2,5,5,5-octafluoro-4-trifluoromethylpentane and having a weight ratio of 1,1,1,2,2,3,5,5,5-nonafluoro-4-trifluoromethylpentane to 1,1,1,2,2,5,5,5-octafluoro-4-trifluoromethylpentane between about 1:6 and 5:1.

6. The composition of claim 3 in which no component contains chlorine.

7. The composition of claim 4 which is a mixture of 1,1,1,2,2,3,5,5,5-nonafluoro-4-trifluoromethylpentane, 1,1,1,2,2,5,5,5-octafluoro-4-trifluoromethylpentane and solvent selected from the group consisting of methanol and ethanol.

8. A composition comprising from about 11 to 78 weight percent 1,1,1,2,2,3,5,5,5-nonafluoro-4-trifluoromethylpentane, and from about 13 to 80 weight percent 1,1,1,2,2,5,5,5-octafluoro-4-trifluoromethylpentane, provided that the total of 1,1,1,2,2,3,5,5,5-nonafluoro-4-trifluoromethylpentane and 1,1,1,2,2,5,5,5-octafluoro-4-trifluoromethylpentane is from about 88 to 96 weight percent, and from about 4 to 12 weight percent methanol.

9. The composition of claim 8 consisting essentially of about 92 weight percent total of 1,1,1,2,2,3,5,5,5-nonafluoro-4-trifluoromethylpentane and 1,1,1,2,2,5,5,5-octafluoro-4-trifluoromethylpentane, and about 8 weight percent methanol.

10. The composition of claim 8 wherein the composition has a boiling point of about 46° C. at substantially atmospheric pressure.

11. A composition comprising from about 28 to 77 weight percent 1,1,1,2,2,3,5,5,5-nonafluoro-4-trifluoromethylpentane, and from about 16 to 65 weight percent 1,1,1,2,2,5,5,5-octafluoro-4-trifluoromethylpentane, provided that the total of 1,1,1,2,2,3,5,5,5-nonafluoro-4-trifluoromethylpentane and 1,1,1,2,2,5,5,5-octafluoro-4-trifluoromethylpentane is from about 88 to 96 weight percent, and from about 4 to 12 weight percent ethanol.

12. The composition of claim 11 consisting essentially of about 92 weight percent total of 1,1,1,2,2,3,5,5,5-nonafluoro-4-trifluoromethylpentane, and 1,1,1,2,2,5,5,5-octafluoro-4-trifluoromethylpentane and about 8 weight percent ethanol.

13. The composition of claim 11 wherein the composition has a boiling point of about 52° C. at substantially atmospheric pressure.

14. A process for cleaning a solid surface which comprises treating said surface with a composition comprising (i) between about 5 to 99 weight percent total of 1,1,1,2,2,3,5,5,5-nonafluoro-4-trifluoromethylpentane, and 1,1,1,2,2,5,5,5-octafluoro-4-trifluoromethylpentane, and (ii) between about 1 and 80 percent by weight of at least one solvent selected from the group consisting of alcohols containing from 1 to 4 carbon atoms, esters containing from 3 to 6 carbon atoms, ethers containing from 2 to 6 carbon atoms, ketones containing from 3 to 6 carbon atoms, halogenated hydrocarbons containing from 1 to 4 carbon atoms, acetonitrile and nitromethane; wherein the weight ratio of 1,1,1,2,2,3,5,5,5-nonafluoro-4-trifluoromethylpentane to 1,1,1,2,2,5,5,5-octafluoro-4-trifluoromethylpentane is between about 1:6 and 5:1.

15. The process of claim 14, wherein said surface is treated with a mixture in which no component contains chlorine.

16. The process of claim 14, wherein the solid surface is a printed circuit board contaminated with flux and flux residues.

17. The process of claim 14 which comprises treating said surface either with a composition comprising from about 11 to 78 weight percent 1,1,1,2,2,3,5,5,5-nonafluoro-4-trifluoromethylpentane, from about 13 to 80 weight percent 1,1,1,2,2,5,5,5-octafluoro-4-trifluoromethylpentane, and from about 4 to 12 weight percent methanol, or with a composition comprising from about 28 to 77 weight percent 1,1,1,2,2,3,5,5,5-nonafluoro-4-trifluoromethylpentane, from about 16 to 65 weight percent 1,1,1,2,2,5,5,5-octafluoro-4-trifluoromethylpentane, and from about 4 to 12 weight percent ethanol; provided that the total 1,1,1,2,2,3,5,5,5-nonafluoro-4-trifluoromethylpentane and 1,1,1,2,2,5,5,5-octafluoro-4-trifluoromethylpentane in the is from about 88 to 96 weight percent.

* * * * *